United States Patent [19]

Goldenberg

[11] 4,131,278

[45] Dec. 26, 1978

[54] GAME RACKET WITH SEMI-RESILIENT IMPACT SURFACES AND AN OFFSET HANDLE

[75] Inventor: Joseph Goldenberg, Hyattsville, Md.

[73] Assignee: Pap-et, Inc., Washington, D.C.

[21] Appl. No.: 804,386

[22] Filed: Jun. 7, 1977

[51] Int. Cl.[2] ..... A63B 59/00

[52] U.S. Cl. ..... 273/67 R

[58] Field of Search ..... 273/67 R, 67 B, 73 R, 273/73 C, 76

[56] References Cited

U.S. PATENT DOCUMENTS

| | | | |
|---|---|---|---|
| D. 191,405 | 9/1961 | Wagner | 273/76 X |
| 1,700,251 | 1/1929 | Contolini | 273/67 B |

FOREIGN PATENT DOCUMENTS

| | | | |
|---|---|---|---|
| 2407213 | 8/1975 | Fed. Rep. of Germany | 273/76 |
| 834280 | 5/1960 | United Kingdom | 273/76 |

*Primary Examiner*—Richard J. Apley

*Attorney, Agent, or Firm*—Herman L. Gordon

[57] ABSTRACT

A game racket for a game generally similar to tennis but not employing a net, the racket consisting of a main body formed by a rigid ring with thin plate-like but resilient panels peripherally sealingly secured on opposite sides of the ring, defining a sealed air chamber therebetween. The ring has a handle which is offset from the center line of the racket by a distance sufficient to enable the user's index finger to supportingly engage the back of the main body substantially along the center line when the racket is gripped, so as to provide improved control of the racket when striking a ball and to relieve wrist tension. The sealed air chamber contributes to the bounce characteristics of the racket by acting as a resiliently compressible gas cell wherein the impacted panel distorts to a greater degree than the opposite panel, causing compression of the contained air which then immediately expands and reacts drivingly on the ball.

3 Claims, 9 Drawing Figures

GAME RACKET WITH SEMI-RESILIENT IMPACT SURFACES AND AN OFFSET HANDLE

FIELD OF THE INVENTION

This invention relates to game rackets, and more particularly to a racket wherein a sealed air chamber is provided immediately behind the game ball contact surface and wherein the properties of the air in the sealed chamber contribute to the driving characteristics of the racket.

BACKGROUND OF THE INVENTION

Various games have been formulated of types resembling tennis, ping-pong, and the like, wherein the playing area is provided with a net, and a ball is driven back and forth by the players over the net into designated areas on opposite sides of the net. In such games the players employ rackets wherein, in the case of tennis, the game ball contact surfaces consist of mesh strings, and, in the case of ping-pong, the game ball contact surfaces consist of relatively rigid solid paddle blades. These game ball contact surfaces are employed mainly because of the particular physical characteristics of the game balls used in the respective games. In the case of the mesh-strung rackets, the net mass of the frame and strings is not very great as compared with that of the handle, so that the racket is quite maneuverable. In the case of a ping-pong paddle, the playing area is relatively small, the game ball is very light and resilient, and the paddle is very light and rigid, so that it is easy to control.

In a game as contemplated by the present invention, the playing area is of the order of 27 feet in length and 18 feet in width and does not employ a net. Instead, there is a central rectangular dead zone of the order of 6 feet long and 4 feet wide over which the ball must be driven into designated playing areas. In this game, a smooth hollow rubber ball is employed which is about 2 1/16 inches in outside diameter and has a wall thickness of about $\frac{1}{8}$ inch. The ball is relatively lively as compared with a conventional tennis ball, requiring the use of rackets which are highly responsive to ball impact and which can be accurately controlled without imposing excessive wrist tension on the players. This game requires highly accurate driving of the ball for distances of 20 feet or more.

SUMMARY OF THE INVENTION

Accordingly, a main object of the invention is to provide a novel and improved game racket for use in a game as above described, the racket being relatively simple in construction and being arranged so that a player may grip the handle of the racket and employ his index finger to engage the back of the blade of the racket with his index finger in supporting contact therewith along the center line of the racket so as to provide maximum handling stability, relieve wrist tension, enable better and more efficient ball-driving impact, and improve the player's accuracy in driving the game ball.

A further object of the invention is to provide an improved game racket which is sturdy in construction, which is relatively light in weight, which can be employed to accurately drive a relatively lively game ball for distances of the order of at least 20 feet, and which utilizes to an appreciable degree the resilient characteristics of confined air to impart driving force to the game ball.

A still further object of the invention is to provide an improved game racket which can be fabricated from relatively inexpensive materials, which can be employed to accurately drive a relatively lively game ball for substantial distances for prolonged periods of time without excessive wrist tension or fatigue, and which is arranged to comfortably accommodate the player's hand and to enable the player to place his index finger supportingly behind the racket blade substantially at the racket center line so as to provide maximum stability and control of the racket.

BRIEF DESCRIPTION OF THE DRAWINGS

Further objects and advantages of the invention will become apparent from the following description and claims, and from the accompanying drawings, wherein:

DETAILED DESCRIPTION

Figure 1:
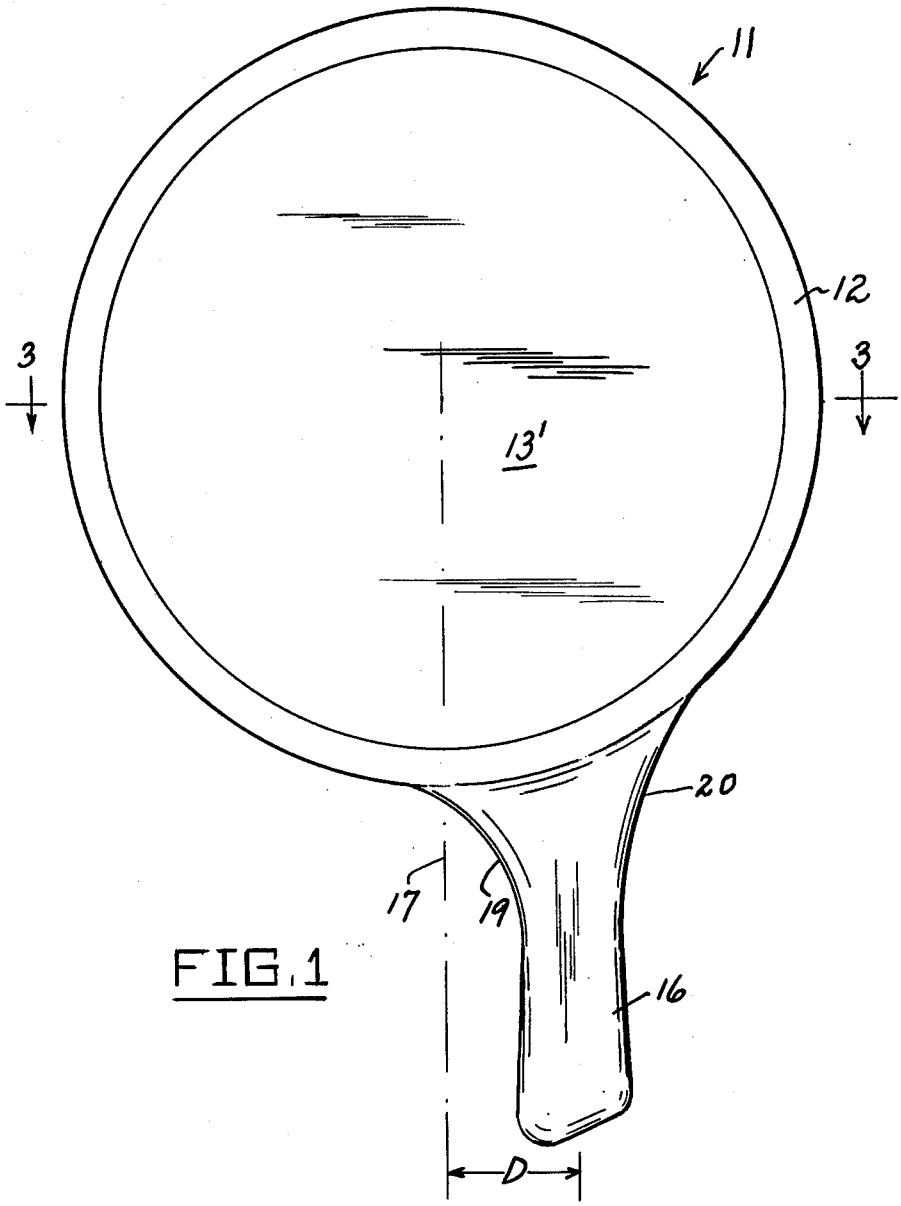
FIG. 1 is a front elevational view of an improved game racket constructed in accordance with the present invention and employing a circular impact blade.

Referring to the drawings, and more particularly to FIGS. 1 to 3, 11 generally designates a game racket according to the present invention. The racket 11 comprises a main body formed by a generally circular rigid ring 12 with thin plate-like but resilient circular panels 13, 13′ peripherally sealingly secured on opposite sides of the ring. Thus, the ring 12 may be formed with annular rabetted recesses 14, 14 in which the peripheral edges of the discs 13, 13′ are sealingly secured, as by suitable adhesive. This defines a sealed air chamber 15 between the thin semi-resilient circular panels 13, 13′.

In a typical embodiment, the ring 12 is about 10 inches in outside diameter, about $8\frac{3}{4}$ inches in inside diameter, and is about $\frac{5}{8}$ inch thick. The panels 13, 13′ may be of close-grained wood, 1/16 inch thick, and are slightly flexible but are rigidly held at their peripheral edges by the rigid ring 12. Other suitable thin plate-like material having similar semi-resilient characteristics may be used for the panels 13, 13′.

Figure 2:
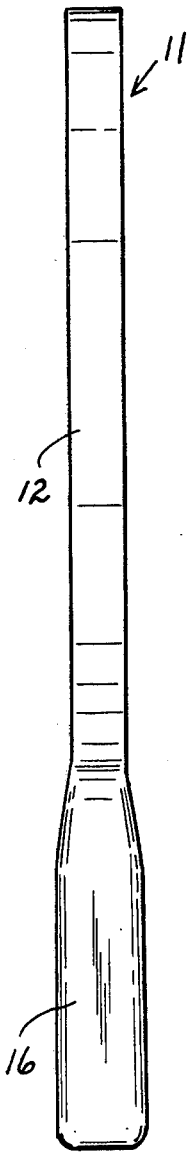
FIG. 2 is a side elevational view of the game racket of FIG. 1.
Figure 3:
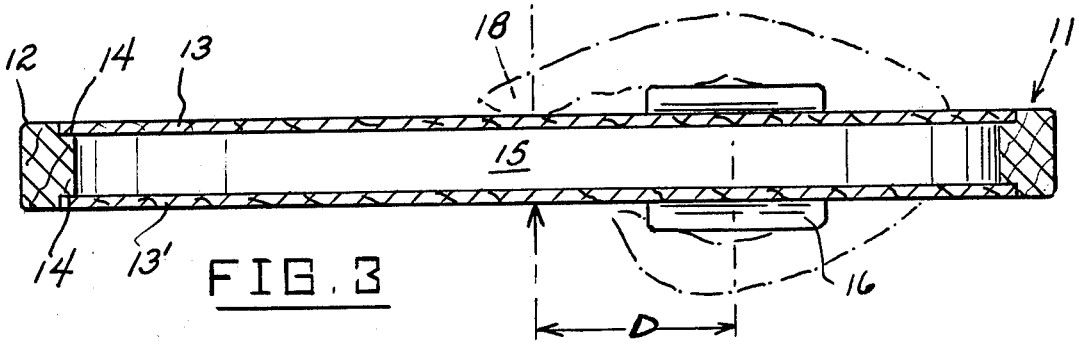
FIG. 3 is an enlarged horizontal cross-sectional view taken substantially on the line 3—3 of FIG. 1 and illustrating how the player's index finger can supportingly engage the back of the racket substantially along its center line.

In the typical embodiment shown in FIGS. 1 to 3, the frame of the racket comprises the ring 12, integrally formed with a gripping handle 16 which is parallel to but whose axis is laterally offset from the center line 17 of the racket by a suitable distance D selected to enable a user's index finger, as shown at 18 in FIG. 3, to supportingly engage the back panel of the hollow blade portion of the racket substantially along the center line 17 when the handle 16 is gripped. Said frame is formed of any suitable durable material, such as wood, metal or plastic. To facilitate gripping of the handle, the inner corner between handle 16 and ring 12, shown at 19, has a relatively short radius of curvature, and the outer corner 20 between said handle and the ring has a relatively large radius of curvature. In the typical embodiment above mentioned, the distance D is about 1⅞ inches, considered to be suitable for an average hand. The overall length of the handle 16 in said typical embodiment is about 4¾ inches. The handle is suitably thickened to provide a good grip, and in the above-mentioned typical embodiment said handle has a generally rectangular cross-section about 1½ inch by 1 inch, with its longer dimension extending parallel to the plane of the blade portion of the racket.

A player grasps the handle 16 in the manner illustrated in broken-line view in FIG. 3, with his index finger 18 engaged with the back panel 13 at the center line 17, as above stated. In using the racket, the player endeavors to strike the ball in a manner such that the ball contact will preferably be near the center of the front panel 13' to permit maximum inward flexure of said front panel. Such flexure occurs because of the inherent resiliency of the thin wood panel. The distortion of the front panel 13' is relatively great as compared with that of the rear panel 13 because of the direct impact of the game ball with said front panel. This initially compresses the confined air in the space 15, which thereafter expands, after said impact, and acts in a manner similar to a spring to impart additional driving force to the ball. As a result, this enables the player to drive the ball with great velocity toward the designated playing area covered by his opponent, and the direction of the driving force may be accurately controlled because of the guiding action provided by the user's index finger 18.

Figure 4:
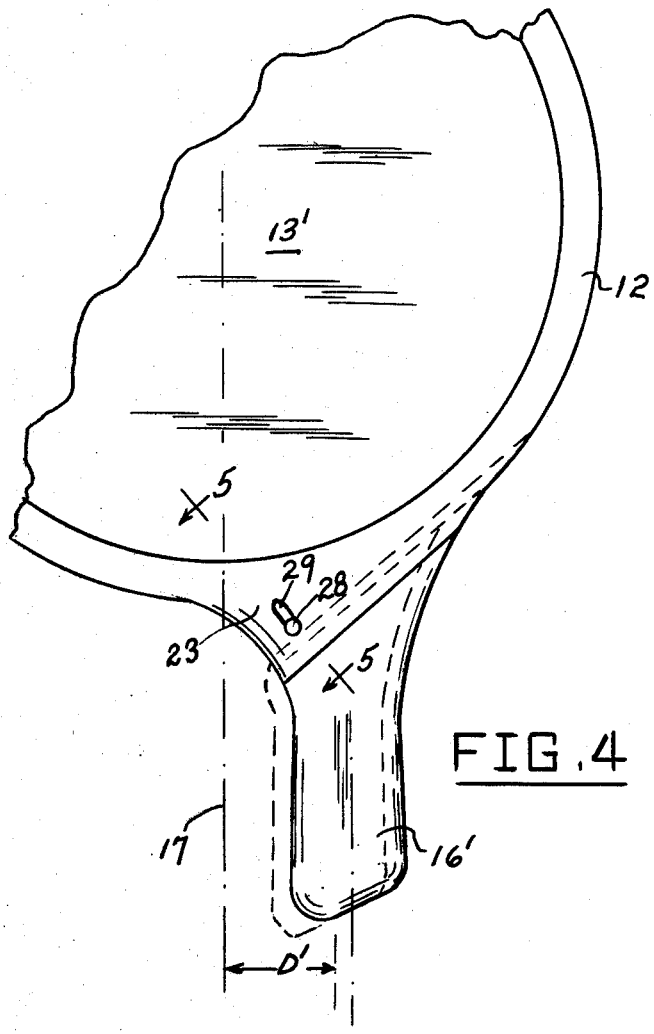
FIG. 4 is a fragmentary front elevational view of a modification of a game racket according to the present invention, wherein the location of the handle is adjustable relative to the center line of the racket.
Figure 7:
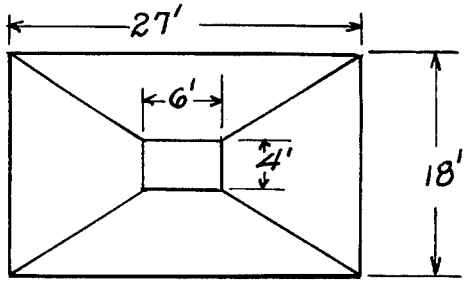
FIG. 7 is a dimensioned diagram of a typical playing court for a ball game employing rackets according to the present invention.
Figure 5:
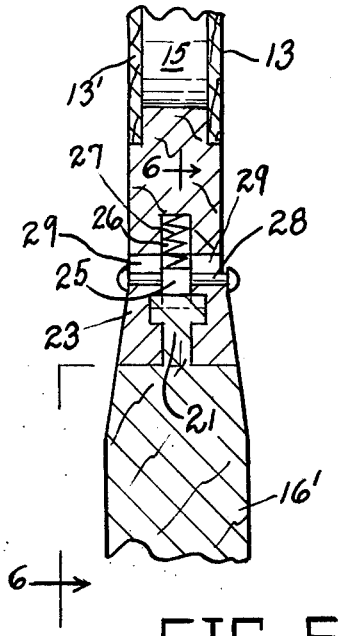
FIG. 5 is an enlarged fragmentary cross-sectional detail view taken substantially on the line 5—5 of FIG. 4.
Figure 6:
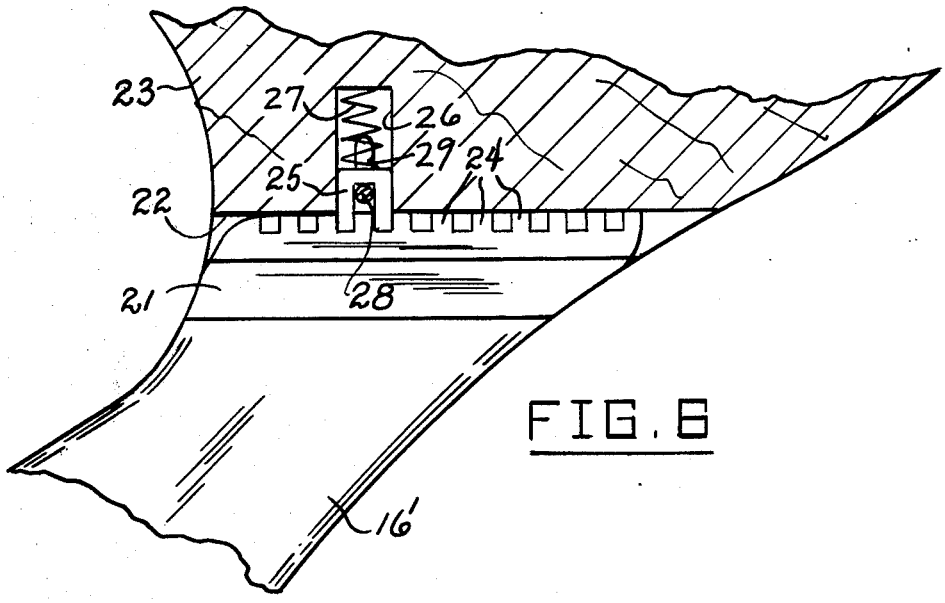
FIG. 6 is an enlarged fragmentary cross-sectional view taken substantially on the line 6—6 of FIG. 5.

Due to variations in the size of player's hands, it is advantageous to be able to adjust the offset distance D. For a small hand the center line of the handle should be closer to the center line of the racket than the average distance employed in the previously described embodiment comprising a one-piece frame, and conversely, for a player with an unusually large hand the offset should be greater. FIGS. 4 to 6 disclose a modified racket wherein the handle may be adjusted to set the offset distance over a wide range of values. The handle, shown at 16', is slidably connected to the main racket body for adjustment laterally, as viewed in FIG. 4, by the provision of an inclined T-shaped rib 21 on the top end of the handle, which slidably engages in a matching inclined T-groove 22 provided in the bottom edge of the handle root portion 23 of the main racket body. As shown in FIG. 4, said handle root portion 23 is substantially triangular and its bottom edge extends substantially tangentially to the ring element 12. The top edge of the handle 16' matches the bottom edge of portion 23 in inclination.

The head of the T-shaped rib 21 is formed with transverse rack teeth 24. A generally rectangular U-shaped detent yoke 25 is slidably and non-rotatably engaged in a rectangular recess 26 formed in portion 23, extending perpendicular to T-groove 22, as shown in FIG. 6. A coiled spring 27 is provided in recess 26, bearing between yoke 25 and the end wall of the recess, biasing yoke 25 downwardly, as viewed in FIG. 6. Yoke 25 is engageable over a selected transverse rack tooth 24 to lock the handle in a correspondingly adjusted position. A transverse oppositely headed pin 28 extends through yoke 25 and opposite slots 29, 29 provided in portion 23 and located in a plane perpendicular to T-groove 22. By manually elevating the pin 28, the yoke 25 may be raised sufficiently to release T-shaped rib 21 and to therefore allow handle 16' to be moved to a desired position of adjustment relative to the main racket body, after which pin 28 may be released to lock the handle in its adjusted position wherein the center line of the handle is at a desired new offset distance D' from the center line 17 of the racket.

Figure 8:
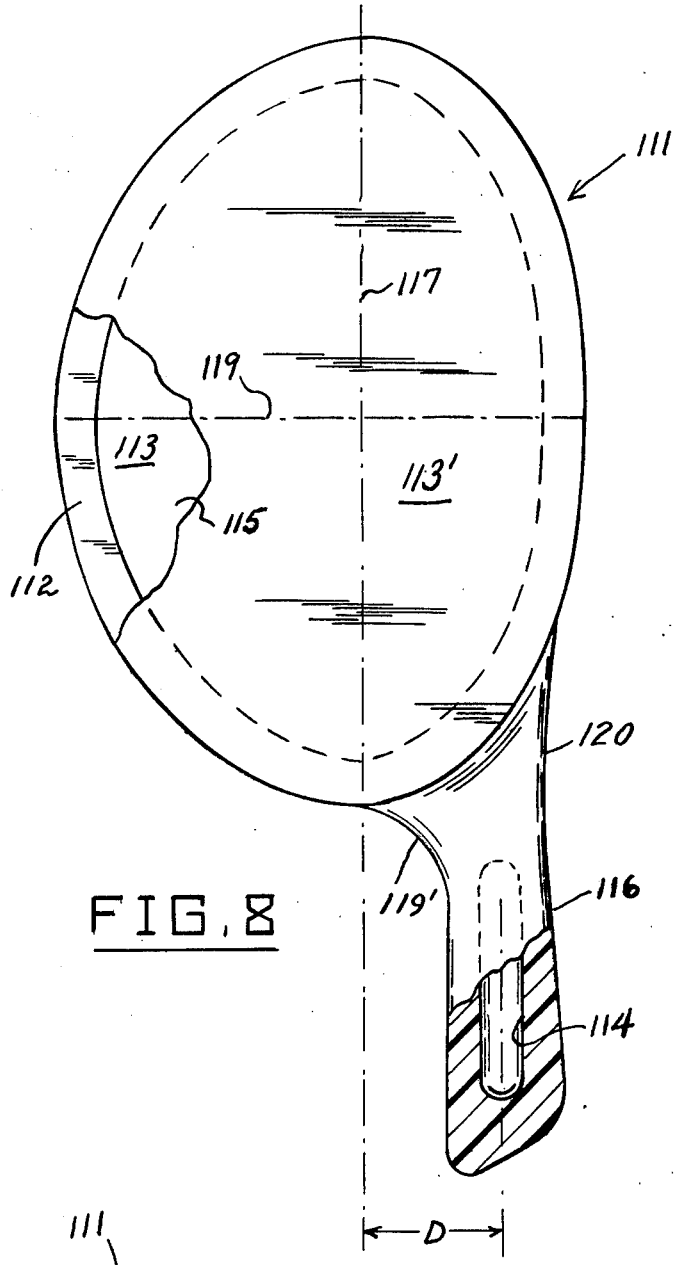
FIG. 8 is a front elevational view, partly broken away, of another improved game racket constructed in accordance with the present invention.
Figure 9:
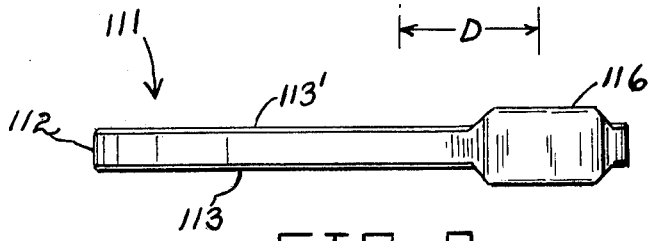
FIG. 9 is an end elevational view of the game racket of FIG. 8.

FIGS. 8 and 9 show a further improved form of game racket according to the present invention, designated generally at 111, and comprising a main body formed by a generally oval asymmetrical, rigid ring 112, with thin plate-like but resilient panels 113, 113' of corresponding shape, peripherally secured on opposite sides of the ring. The panels 113, 113' may be of any suitable generally resilient material, such as sheet plastic or wood, and may be sealingly secured at their margins to the opposite sides of the ring 112 by suitable adhesive, defining the sealed air chamber 115. The frame of the racket comprises the ring 112, integrally formed with a hollow handle 116 which is parallel to but whose axis is laterally offset from the major axis 117 of the ring 112 by a suitable distance D selected to enable a user's index finger to supportingly engage the back panel of the hollow blade portion of the racket substantially along said major axis when the handle is gripped. Said frame may be formed of any suitable durable material, such as clear Lucite. The purpose of the cavity 114 in the handle is to reduce its weight. As shown in FIG. 8, the ring 112 is laterally asymmetrical, the radius of curvature of the ring at the minor axis along the handle axis being substantially greater than the radius of curvature of the ring at said minor axis at the side thereof oppposite the handle axis.

The inner corner between handle 116 and ring 112, shown at 119', has a relatively short radius of curvature, and the outer corner 120 between said handle and the ring has a relatively large radius of curvature.

In a typical embodiment, the major axis of the ring was about 10 inches in length and the minor axis, shown at 119, was about 6⅞ inches in length; the handle 116 was about 4½ inches in length, about 1⅜ maximum width, and about 1 inch in thickness.

While certain specific embodiments of improved game rackets have been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A game racket comprising a main body including means defining a flat sealed air chamber having resiliently yieldable plate-like striking surfaces, and a handle connected to said main body on an axis parallel to but offset from a center line of said main body by a distance sufficient to enable a user's index finger to supportingly engage behind said main body substantially at said center line, whereby to provide guiding support of the racket when striking a ball, wherein said main body comprises a rigid ring member with relatively thin plate-like front and rear panels peripherally sealingly secured on opposite sides of said ring member, wherein said ring member is substantially oval in shape and is continuously outwardly convex at its opposite lateral sides, the major axis of the ring member extending substantially parallel to said handle, wherein the radius of curvature of the ring member at the minor axis of the ring member is substantially greater at the lateral side thereof near the handle axis than at the lateral side thereof remote from the handle axis, and wherein the corner between said handle and the smaller-radius lateral side of the ring member is arcuately curved with a relatively short radius of curvature and the corner between said handle and the larger-radius lateral side of the ring member is arcuately curved with a relatively long radius of curvature, to facilitate gripping of the handle.

2. The game racket of claim 1, and wherein said front and rear panels comprise plates approximately 1/16 inch in thickness.

3. The game racket of claim 1, and wherein the handle is hollow.

* * * * *